US005860716A

United States Patent [19]

Good et al.

[11] Patent Number: 5,860,716

[45] Date of Patent: Jan. 19, 1999

[54] DISHWASHER RACK ADJUSTMENT MECHANISM

[75] Inventors: Robert W. Good, Kinston; Deborah L. Harr, Snow Hill, both of N.C.

[73] Assignee: White Consolidated Industries, Inc., Cleveland, Ohio

[21] Appl. No.: 827,599

[22] Filed: Mar. 28, 1997

[51] Int. Cl.[6] ..... A47B 57/48

[52] U.S. Cl. ..... 312/311; 312/334.12; 312/334.4; 312/351

[58] Field of Search ..... 312/311, 334.4, 312/334.7, 334.12, 351; 211/41.8, 208; 248/297.31

[56] References Cited

U.S. PATENT DOCUMENTS

| | | | |
|---|---|---|---|
| 2,739,864 | 3/1956 | Saunders . | |
| 2,787,381 | 4/1957 | Hallock . | |
| 3,269,548 | 8/1966 | Geiger et al. . | |
| 3,306,693 | 2/1967 | Kauffman . | |
| 3,472,573 | 10/1969 | Geiger . | |
| 3,486,804 | 12/1969 | Kaufman et al. . | |
| 3,560,069 | 2/1971 | Doepke . | |
| 3,614,187 | 10/1971 | Cuthbert . | |
| 3,726,580 | 4/1973 | Guth | 312/311 X |
| 3,726,581 | 4/1973 | Doepke | 312/311 X |
| 3,734,589 | 5/1973 | Morgan . | |
| 3,736,037 | 5/1973 | Doepke . | |
| 3,737,209 | 6/1973 | Manor . | |
| 3,761,153 | 9/1973 | Guth . | |
| 3,768,883 | 10/1973 | Kauffman . | |
| 3,809,450 | 5/1974 | Guth . | |
| 3,809,451 | 5/1974 | Pitstick . | |
| 3,822,085 | 7/1974 | Clark . | |
| 3,892,453 | 7/1975 | Daily . | |
| 3,908,681 | 9/1975 | Schimke et al. . | |
| 4,064,887 | 12/1977 | Geiger et al. . | |
| 4,097,098 | 6/1978 | Fields . | |
| 4,097,099 | 6/1978 | Spiegel | 312/311 |
| 4,226,490 | 10/1980 | Jenkins et al. . | |
| 4,290,660 | 9/1981 | Brezosky . | |
| 4,449,765 | 5/1984 | Lampman . | |
| 5,044,666 | 9/1991 | Griesemer . | |
| 5,115,822 | 5/1992 | Nichols . | |
| 5,303,997 | 4/1994 | Kropf . | |
| 5,409,309 | 4/1995 | Giddings et al. . | |
| 5,474,378 | 12/1995 | Smith et al. . | |
| 5,657,878 | 8/1997 | Austin | 312/334.4 X |

FOREIGN PATENT DOCUMENTS

| | | |
|---|---|---|
| 4228954 | 3/1994 | Germany . |

*Primary Examiner*—Peter M. Cuomo
*Assistant Examiner*—David E. Allred
*Attorney, Agent, or Firm*—Pearne, Gordon, McCoy & Granger LLP

[57] ABSTRACT

A pair of support assemblies for an upper rack of a washer. Each of the support assemblies includes an arm, a bracket, a carriage, and a lever. The arms each have a plurality of vertical teeth. The carriages are movably disposed within the tracks. The carriages are respectively joined to the arms and each have a pair of wheels rotatably mounted thereto. The brackets are respectively attached to opposing side structures of the upper rack. The brackets each define a passage through which one of the arms extends. The brackets are movable along the arms so as to permit the upper rack to be movable between a plurality of vertical positions. A pair of levers are respectively joined to the brackets and each have a detent. The detents are engaged with the arms so as to lock the brackets to the arms at a first one of the vertical positions. The levers are resiliently movable to permit the detents to be disengaged from the arms, thereby permitting the upper rack to be moved to a second one of the vertical positions, where the detents can be re-engaged with the arms to lock the brackets to the arms at the second one of the vertical positions.

17 Claims, 6 Drawing Sheets

Fig.6
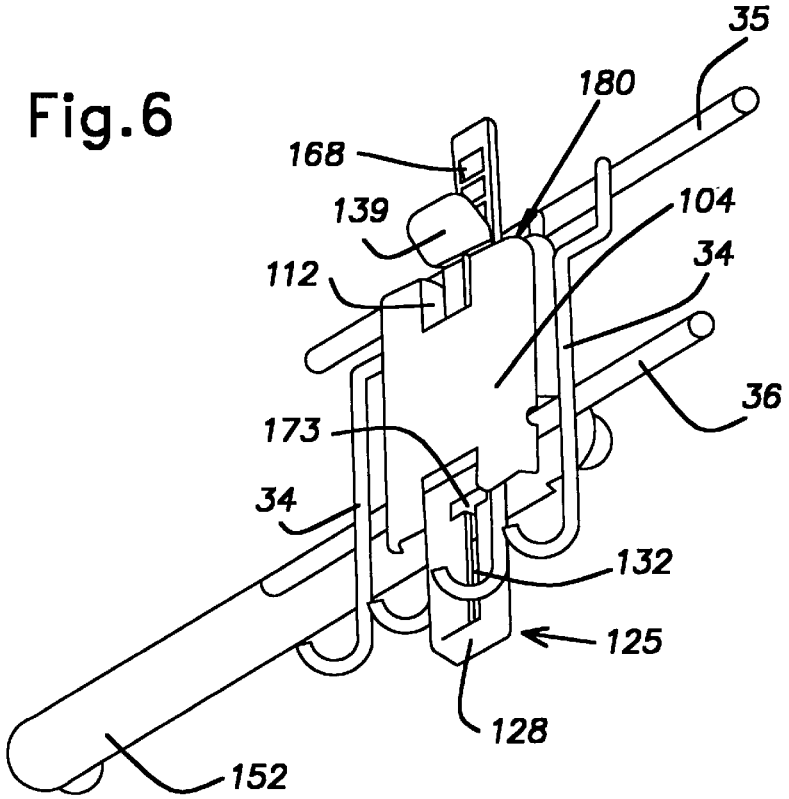
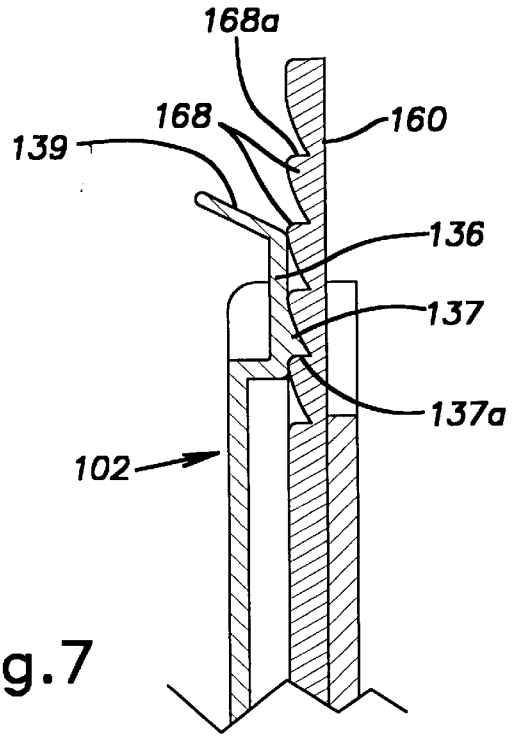
Fig.7

DISHWASHER RACK ADJUSTMENT MECHANISM

BACKGROUND OF THE INVENTION

1. Field of the Invention

This invention relates to washers in general and, more particularly, to dishwashers having an adjustable upper dishrack.

2. Description of the Related Art

A front-loading washer, such as a dishwasher, typically includes a tub having an open front. The tub defines a wash chamber wherein wash items, such as dishes, are cleansed with a wash fluid. The washer is usually provided with a horizontally-pivoting door for closing the open front, and upper and lower dishracks for holding wash items. The upper and lower dishracks are separated by a vertical spacing and are usually movable in and out of the wash chamber so as to permit wash items to be loaded into, or unloaded from, the upper and lower dishracks.

Conventionally, the upper dishrack is provided with wheel assemblies to permit the upper dishrack to move in and out of the wash chamber. The wheel assemblies are attached to opposing sides of the upper dishrack and are carried in tracks secured to opposing side walls of the tub. The wheel assemblies roll along the tracks when the upper dishrack is moved into, or out of, the wash chamber.

Since the height and width of a washer is typically limited by industry standards, it has been found advantageous to enable the vertical spacing between the upper and lower dishracks to be changed so as to maximize the use of available space in the wash chamber. Specifically, it has been found advantageous to be able to change the height or vertical level of the upper dishrack so that large items, such as cookie sheets or tall glasses can be placed in the lower dishrack without contacting the bottom of the upper dishrack. Accordingly, prior art front-loading dishwashers have been developed to provide a vertically-adjustable upper dishrack. Examples of such prior art dishwashers include U.S. Pat. No. 5,474,378 to Smith et al., U.S. Pat. No. 3,736,037 to Doepke, U.S. Pat. No. 3,726,580 to Guth and U.S. Pat. No. 3,726,581 to Doepke, all of which are incorporated herein by reference.

Each of the foregoing references shows a front-loading dishwasher with an upper dishrack supported by four vertically-adjustable support assemblies. The support assemblies each have first and second members slidably interconnected with each other. The first member is attached to the upper dishrack, while the second member is interconnected with a wheel received within a track supported on a side wall of a tub. One of the first and second members is resiliently movable to change the height of the support assembly.

In 037 Doepke, Guth and 581 Doepke, the support assemblies are complicated devices. In each of these references, springs are utilized to make the first or second members resiliently movable, and the first members appear to be welded or otherwise permanently joined to the upper dishrack. In addition, in each of these references, two of the support assemblies are located on each side of the upper dishrack, and are connected together by a control linkage. As can be appreciated, such complicated support assemblies are expensive to manufacture and install. Furthermore, in each of these references, the support assemblies can only be accessed from underneath the upper dishrack.

Smith addresses some of the disadvantages of 037 Doepke, Guth and 581 Doepke. For example, the support assemblies in Smith appear to be relatively inexpensive to manufacture and can be accessed from above the upper dishrack. The support assemblies in Smith, however, require greater operator manipulation to change the height of the upper dishrack than 037 Doepke, Guth and 581 Doepke. In Smith, each one of the support assemblies must be individually manipulated, whereas in 037 Doepke, Guth and 581 Doepke, the support assemblies are manipulated in pairs. In addition, the support assemblies in Smith must be manipulated by an operator when the upper dishrack is both raised and lowered, whereas in 037 Doepke, Guth and 581 Doepke, the support assemblies only need to be manipulated by an operator when the upper dishrack is lowered.

In Smith, there are first and second pairs of adjustable support assemblies respectively attached to opposing sides of the upper dishrack. In each of the support assemblies, the first member is a unitary housing that defines a plurality of vertically aligned slots, and the second member is a flex plate slidably interconnected with the housing. The flex plate has a positioning rib that is received within a first one of the slots in the housing so as to secure the housing from vertical movement relative to the flex plate. A wheel is rotatably secured to the flex plate. The wheel is movably secured within the track secured to the side wall of the tub. In order to move the housing upward or downward, the flex plate must be flexed outward to disengage the positioning rib from the first one of the slots. The positioning rib is then moved into alignment with a second one of the slots. The flex plate is then released to allow the positioning rib to engage the second one of the slots. By manipulating all four of the support assemblies in this manner, the dish rack may be moved between a plurality of vertical positions.

With the Smith support assemblies, an operator will not be able to adjust the height of the upper dishrack in one operation because the operator will need to adjust four separate support assemblies. At most, the operator will only be able to adjust two of the support assemblies at one time.

Based upon the foregoing, there is a need in the art for an adjustable support assembly for an upper dishrack wherein the support assembly is inexpensive to manufacture and install, and permits an operator to adjust the height of the upper dishrack without excessive manipulation. The present invention is directed to such an adjustable support assembly.

SUMMARY OF THE INVENTION

It therefore would be desirable, and is an advantage of the present invention, to provide a support assembly that is inexpensive to manufacture and install, and permits an operator to adjust the height of the upper dishrack without excessive manipulation. In accordance with the present invention, a support assembly is provided for supporting a holding rack on a wall-mounted track in a washer. The support assembly includes an arm having a plurality of teeth. A wheel is provided for insertion into the track. The wheel is rotatably interconnected to the arm. A bracket is provided for attachment to the rack. The bracket defines a passage through which the arm extends. The bracket is movable along the arm. A lever is joined to the bracket and has a detent engaged with one of the teeth so as to support the bracket on the arm in a first vertical position. The lever is resiliently movable to permit the detent to be disengaged from the first one of the teeth and moved into engagement with a second one of the teeth, thereby supporting the bracket on the arm in a second vertical position.

Also provided in accordance with the present invention is a holding rack for installation in a washer having a track secured to a side wall of a tub. The rack includes a side structure and an arm having a plurality of retaining structures. A carriage is provided for insertion into the track. The carriage is joined to the arm and has a plurality of wheels rotatably mounted thereto. A bracket is attached to the side structure. The bracket defines a passage through which the arm extends. The bracket is movable along the arm. A lever is joined to the bracket and has a detent. The detent is engaged with a first one of the retaining structures so as to support the side structure on the arm at a first vertical position. The lever is resiliently movable to permit the detent to be disengaged from the first one of the retaining structures and moved into engagement with a second one of the retaining structures, thereby supporting the side structure on the arm in a second vertical position.

Also provided in accordance with the present invention is a washer having a tub with opposing side walls. Each of the side walls has a track secured thereto. A holding rack is provided having opposing side structures. Also provided are a pair of rigid arms. A pair of carriages are movably disposed within the tracks. The carriages are respectively joined to the arms and each have a pair of wheels rotatably mounted thereto. A pair of brackets are respectively attached to the side structures. The brackets each define a passage through which one of the arms extends. The brackets are movable along the arms so as to permit the upper rack to be movable between a plurality of vertical positions. A pair of levers are respectively joined to the brackets and each have a detent. The detents are engaged with the arms so as to lock the brackets to the arms at a first one of the vertical positions. The levers are resiliently movable to permit the detents to be disengaged from the arms, thereby permitting the upper rack to be moved to a second one of the vertical positions and re-engaged with the arms to lock the brackets to the arms at the second one of the vertical positions.

BRIEF DESCRIPTION OF THE DRAWINGS

The features, aspects, and advantages of the present invention will become better understood with regard to the following description, appended claims, and accompanying drawing where:

FIG. 6 shows a side perspective view of the first support assembly; and

FIG. 7 shows a front sectional view of a portion of the first support assembly.

DETAILED DESCRIPTION OF THE PREFERRED EMBODIMENTS

Figure 1:
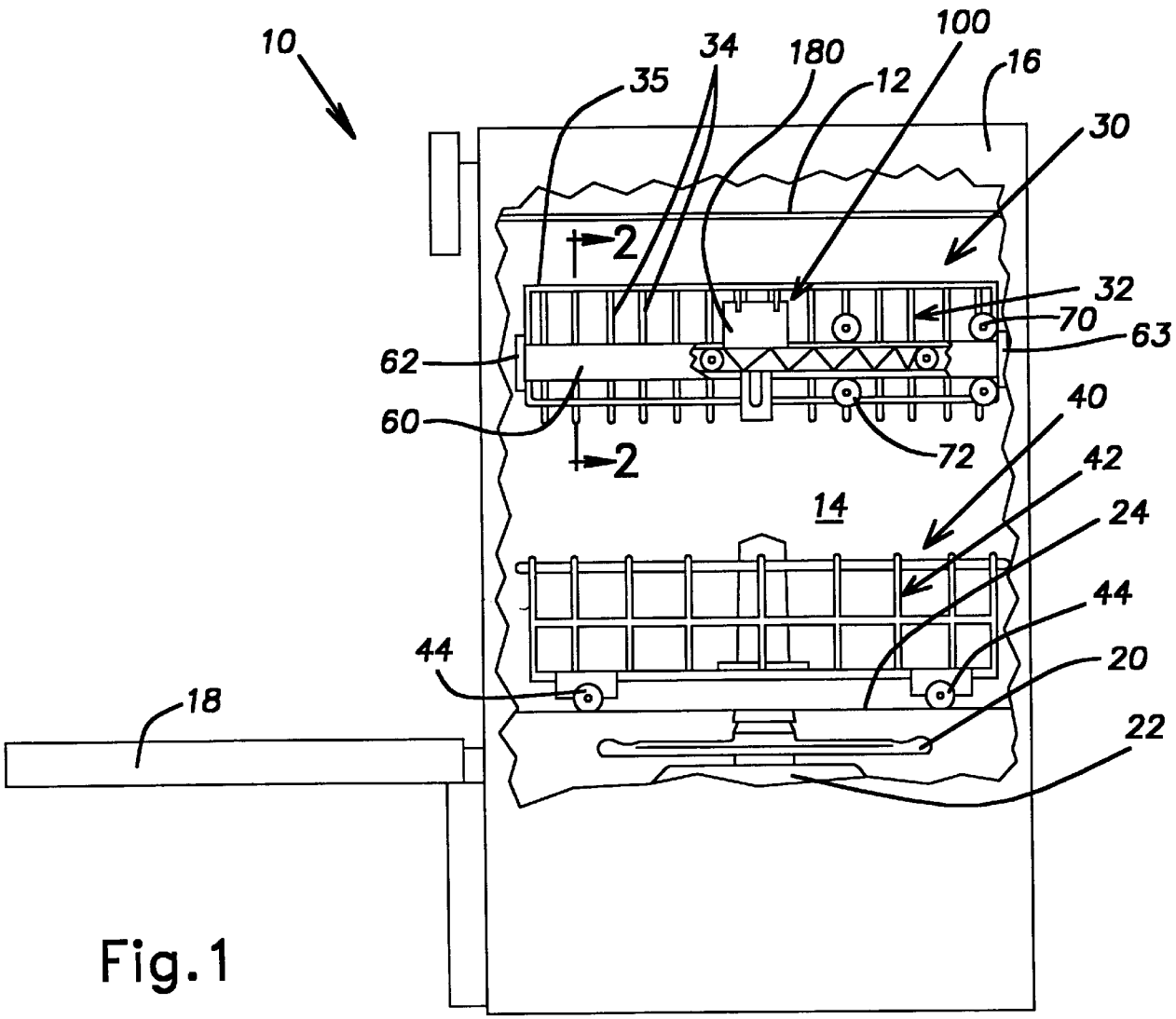
FIG. 1 shows a side view of a washer having a portion cut away to show a first support assembly.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a side view of a front loading washer 10, such as a dishwasher, having a portion cut away to show an interior thereof. The washer 10 includes a tub 12, a housing 16 and a door 18. The tub 12 has opposing side walls 13 (shown best in FIG. 2) and defines a cleaning chamber 14 with a front opening. The door 18 is hingedly mounted below the front opening so as to pivot about a horizontal axis. The door 18 is pivotable between a vertical closed position (not shown), wherein the door 18 covers the front opening, and a horizontal open position (shown in FIG. 1), wherein the door 18 is spaced from the front opening.

Supported within the cleaning chamber 14 are upper and lower racks 30, 40 for holding wash items such as dishes that are to be cleaned in the washer 10. A spray arm 20 is rotatably mounted to a hub 22 below the lower rack 40. When provided with wash fluid from a pump (not shown), the spray arm 20 rotates about the hub 22 and sprays wash fluid upward, toward the upper and lower racks 30, 40.

The lower rack 40 is generally basket-shaped and has a wire frame construction. The lower rack 40 includes lattice-work front, rear, and bottom structures (not shown), as well as lattice-work side structures 42. A plurality of rollers 44 are mounted to each of the side structures 42 of the lower rack 40. The rollers 44 are adapted to track on side wall ridges 24 formed in the tub 12. When the door 18 is in the open position, the rollers 44 permit the lower rack 40 to be moved forward, through the front opening, to an extended position over an inside surface of the door 18. The lower rack 40 can be moved independently from the upper rack 30.

The upper rack 30 is also generally basket-shaped and has a wire frame construction. The upper rack 30 includes lattice-work front, rear, and bottom structures (not shown), as well as opposing lattice-work side structures 32. The side structures 32 are each comprised of vertical wire segments 34, an upper horizontal wire segment 35, and a lower horizontal wire segment 36 (shown in FIG. 6). In each side structure 32, the vertical wire segments 34 and the upper and lower horizontal wire segments 35, 36 are spaced apart to allow wash fluid to freely pass through the side structure 32, while preventing wash items from passing through the side structure 32.

A pair of adjustable support assemblies 100 support the upper rack 30 on a pair of slide bars 60. Each of the slide bars 60 is slidably disposed between a pair of front rollers 70 and a pair of rear rollers 72. In each of the side walls 13 of the tub 12, the front rollers 70 are rotatably secured to the side wall 13, toward the front opening of the cleaning chamber 14, while the rear rollers 72 are rotatably secured to the side wall 13, toward the center of the cleaning chamber 14. In each of the side walls 13, the front rollers 70 are horizontally aligned and vertically spaced apart and the rear rollers 72 are horizontally aligned and vertically spaced apart.

Figure 2:
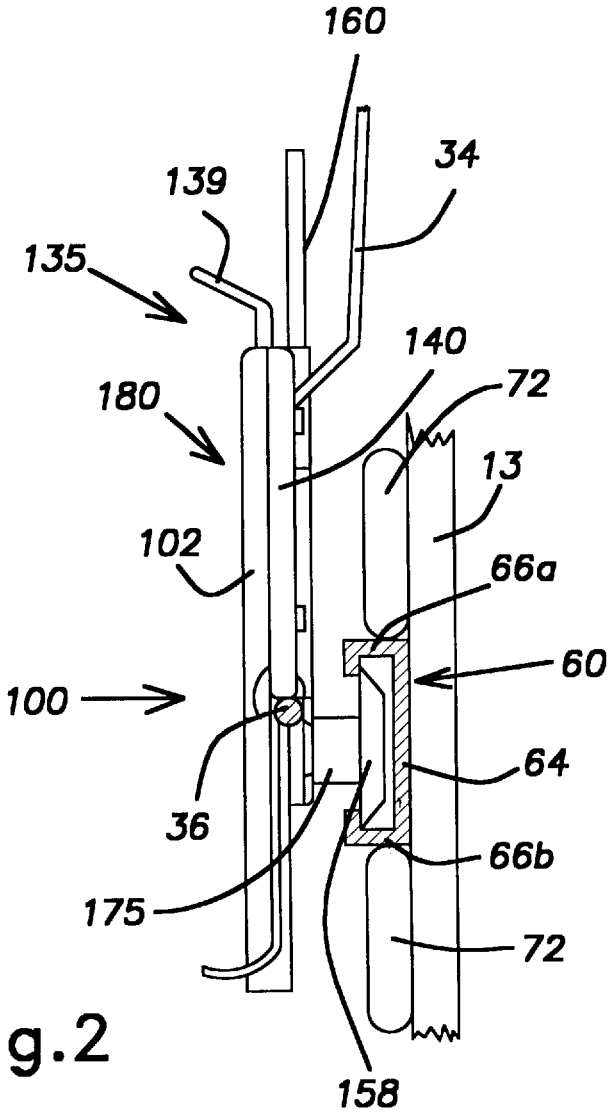
FIG. 2 shows a partial front sectional view of the first support assembly taken along line 2—2 in FIG. 1.
Figure 3:
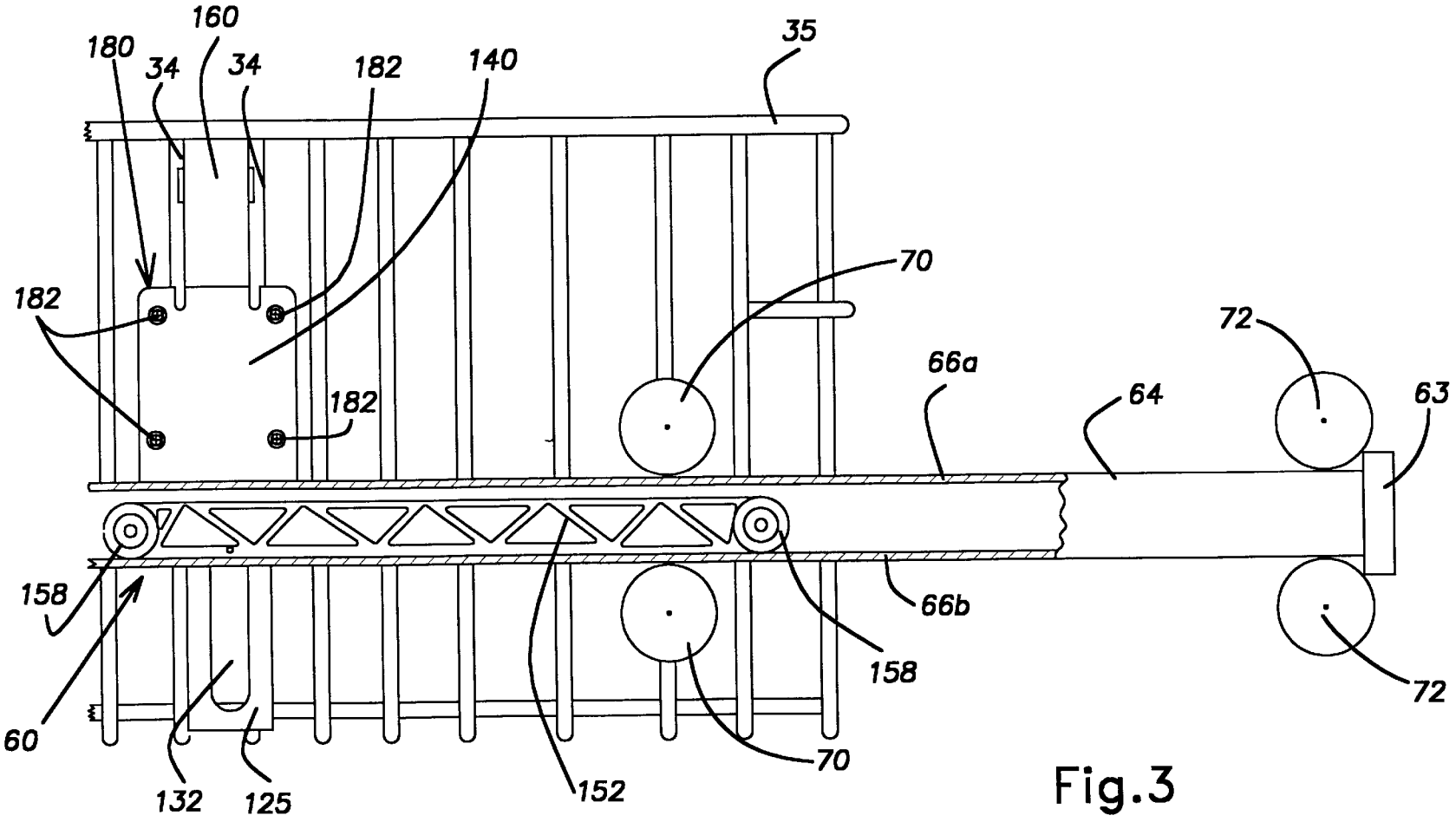
FIG. 3 shows a side view of the first support assembly with a portion of the track cut-away.

Referring now to FIGS. 2, 3, there is respectively shown a partial front sectional view of a first one of the support assemblies 100 taken along line 2—2 in FIG. 1, and a side view of the first one of the support assemblies 100 with a portion of one of the slide bars 60 cut away to better show the mounting of the first one of the support assemblies 100 to the slide bar 60. The slide bar 60 is horizontally oriented between the front rollers 70 and the rear rollers 72. The slide bar 60 is generally channel-shaped and opens inward, toward the upper rack 30. The slide bar 60 includes a front cap 62, a rear cap 63, a central planar member 64, and upper and lower flanges 66*a*, 66*b* extending inward from the central planar member 64. The upper and lower flanges 66*a*, 66*b* extend the length of the central planar member 64 and each have an inturned retaining lip.

Each of the slide bars 60 is movable between a retracted position (shown in FIG. 1), wherein the slide bar 60 is fully disposed inside the wash chamber 14, and an extended position (shown in FIG. 3), wherein the slide bar 60 is partially disposed outside the wash chamber 14. When the slide bars 60 are in the retracted position, the front caps 62 of the slide bars 60 abut the front rollers 72, thereby preventing the slide bars 60 from being slid rearward any farther. When the slide bars 60 are in the extended position, the rear caps 63 of the slide bars 60 abut the rear rollers 72, thereby preventing the slide bars 60 from. being slid forward any farther. In this manner, the front and rear caps 62, 63 maintain the slide bars 60 between the front rollers 70 and between the rear rollers 72.

Figure 4:
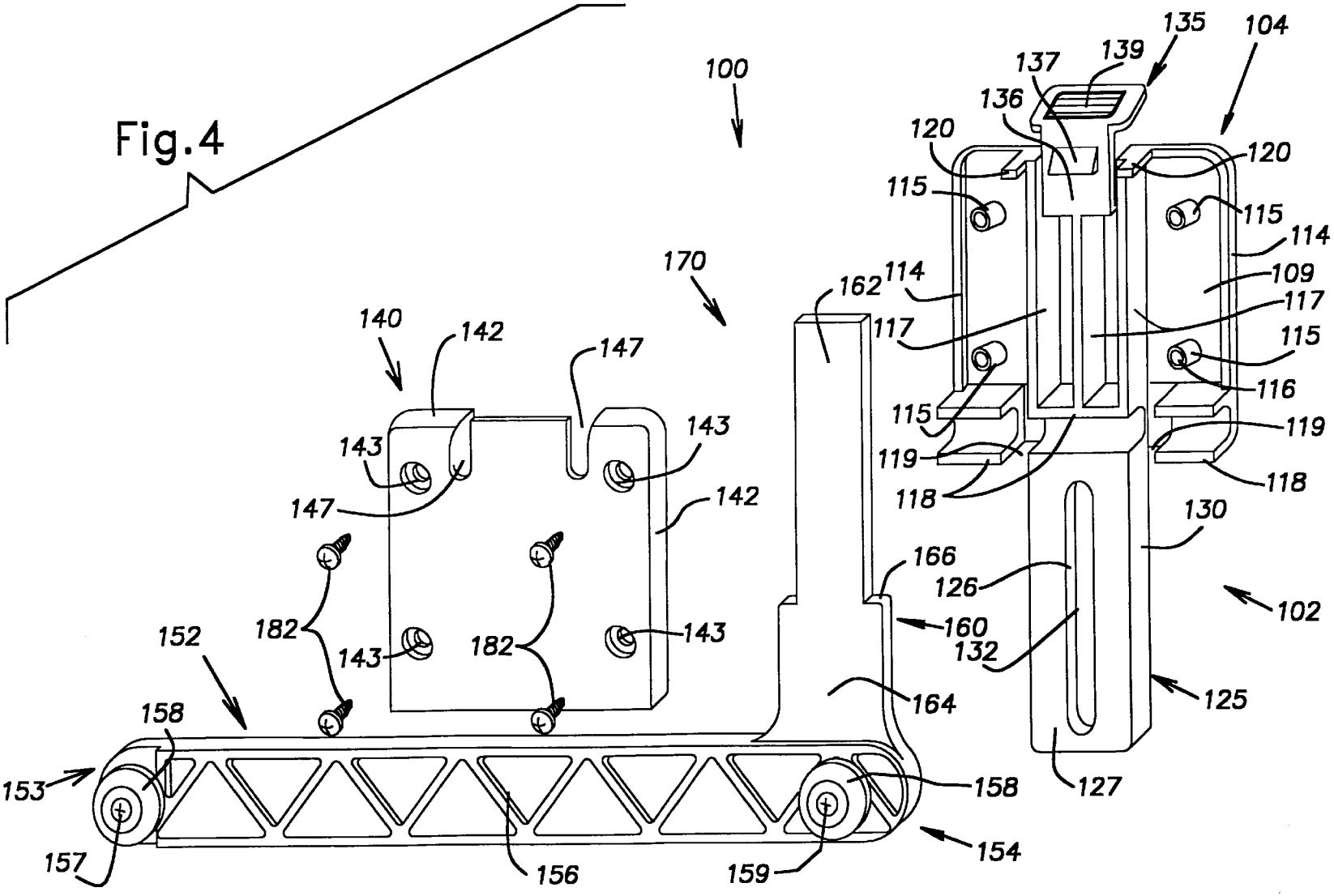
FIG. 4 shows an exploded exterior side view of a second support assembly.
Figure 5:
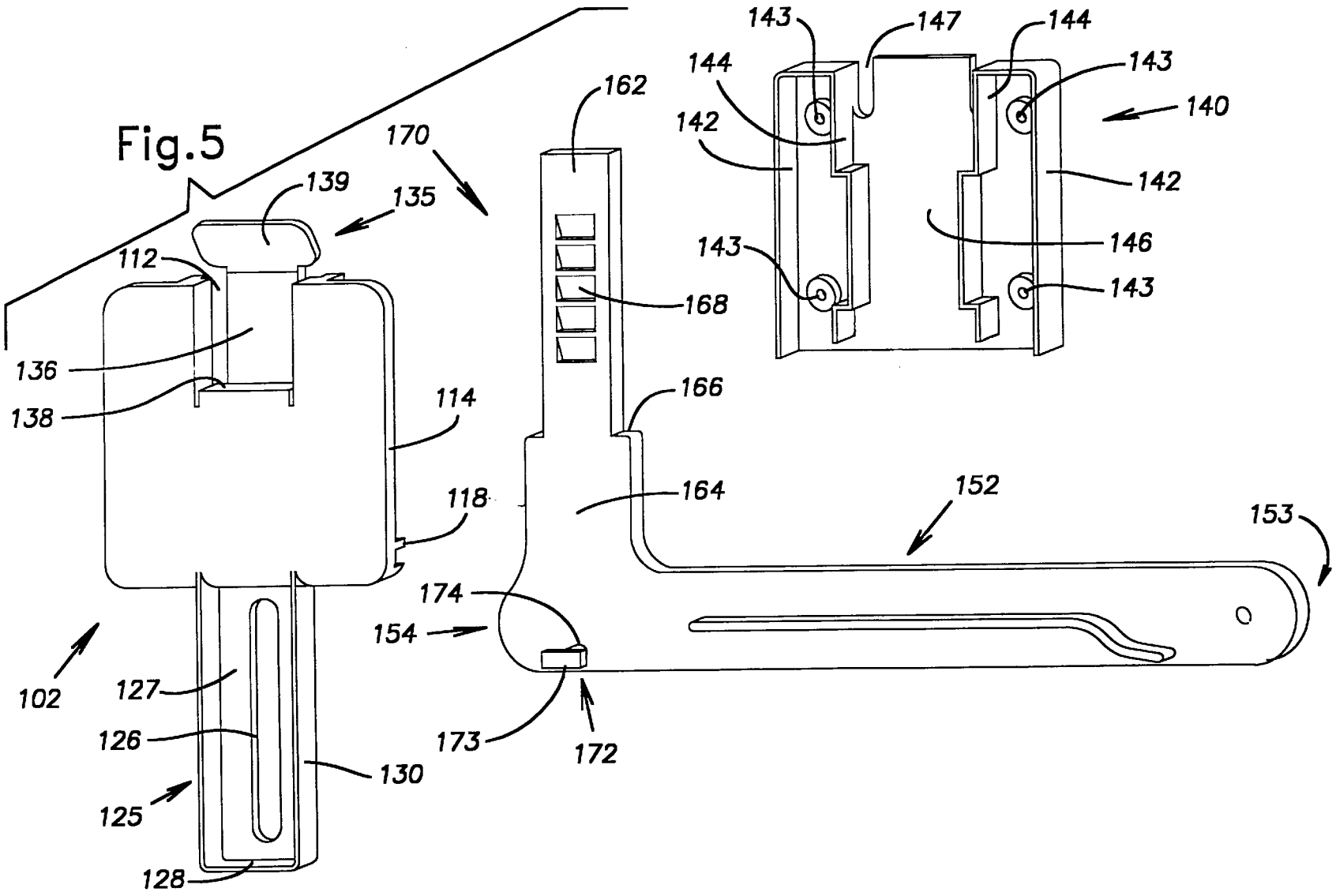
FIG. 5 shows an exploded interior side view of the second support assembly.

Referring now to FIGS. 4 and 5, there is respectively shown exploded exterior and interior side views of a second one of the support assemblies 100. As shown, the second one of the support assemblies 100 is a mirror image of the first one of the support assemblies 100. The support assemblies 100 each include a base structure 102, a cover plate 140, a carriage 152, and an arm 160. As will be described more fully later, the base structure 102 and the cover plate 140 are secured together to form a housing or bracket 180 (shown in FIGS. 1–3).

The base structure 102 has a unitary construction and is preferably composed of plastic. The base structure 102 generally includes a mounting plate 104, a guide bar 125 and a lever 135.

The mounting plate 104 is generally rectangular in shape and has a pair of peripheral flanges 114. Each of the peripheral flanges 114 partially extends along a top edge of the mounting plate 104 and then curves downward to extend along a side edge of the mounting plate 104. The mounting plate 104 defines an enlarged rectangular notch 112 (shown best in FIG. 5) extending downward from the top edge of the mounting plate 104. A pair of guide members 120 extend inward from top portions of the peripheral flanges 114 and are disposed on opposing sides of the notch 112.

A plurality of mounts 115 and a plurality of ribs 117 extend inward from an inner surface 109 of the mounting plate 104. Each of the mounts 115 is generally cylindrical in shape and defines a threaded bore 116. A first pair of the mounts 115 are disposed adjacent to a first one of the side edges of the mounting plate 104 and a second pair of the mounts 115 are disposed adjacent to a second one of the side edges of the mounting plate 104.

Also extending inward from the inner surface 109 are a plurality of C-shaped clips 118. The clips 118 are disposed along a bottom edge of the mounting plate 104 and open inward. A middle one of the clips 118 is disposed between an outer pair of the clips 118 and is joined to the ribs 117. The middle one of the clips 118 is spaced inward from the outer pair of the clips 118 so as to form a pair of gaps 119. The clips 118 are aligned with each other so as to form a horizontal mounting groove.

The guide bar 125 is integrally joined to the mounting plate 104 and extends downward from the middle one of the clips 118. The guide bar 125 is generally channel-shaped and includes a central planar member 127, a bottom wall 128 and a pair of opposing flanges 130 extending away from the central planar member 127. An interior edge 126 of the central planar member 127 defines an elongated slot 132.

The lever 135 is thin and generally L-shaped. The lever 135 includes a horizontal base 138 joined to a vertical body 136. The base 138 is integrally joined to the mounting plate 104, adjacent to a bottom end of the notch 112. Since the lever 135 is thin and is composed of plastic, the lever 135 is bendable at the juncture of the base 138 and the body 136. A lip or detent 137 is integrally joined to the body 136 and extends inward. The detent 137 has a downward slope and terminates at an overhang 137*a* (best shown in FIG. 7).

The body 136 is joined at an upper end to a thumb pad 139. The thumb pad 139 is substantially rectangular and angles rearward from the upper end of the body 136. A pattern of raised ridges is formed in the thumb pad 139 to provide the thumb pad 139 with a textured interior surface.

The cover plate 140 is generally rectangular and has a pair of peripheral flanges 142. Each of the peripheral flanges 142 partially extends along a top edge of the cover plate 140 and then curves downward to extend along a side edge of the cover plate 140. A pair of stepped walls 144 extend from an interior surface 146 of the cover plate 140. The walls 144 are respectively joined to the peripheral flanges 142 at the top edge and extend downward therefrom.

A pair of notches 147 extend downward from the top edge of the cover plate 140 and respectively adjoin the walls 144. A plurality of holes 143 are formed in the cover plate 140. A first pair of the holes 143 are disposed adjacent to a first one of the side edges of the cover plate 140 and a second pair of the holes 143 are disposed adjacent to a second one of the side edges of the cover plate 140.

The carriage 152 is elongated and extends between arcuate posterior and anterior ends 153, 154. A T-shaped projection 172 extends from an interior surface of the carriage 152, toward the anterior end 154. The projection 172 includes a post or base 174 having an inner joined to the interior surface of the carriage 152 and an outer end joined to an elongated head 173. A truss 156 is integrally formed in an exterior surface of the carriage 152, intermediate a pair of posts 175 (shown in FIG. 2).

The posts 175 are generally cylindrical and extend from the exterior surface of the carriage 152. A front one of the posts 175 is integrally joined to the carriage 152 toward the anterior end 154 and a rear one of the posts 175 is integrally joined to the carriage 152 toward the posterior end 153. The front one of the posts 175 defines a threaded bore (not shown), while the rear one of the posts 175 forms a snap-fit 157.

The posts 175 are respectively fitted with a pair of wheels 158. The wheels 158 are generally mushroom-shaped and each have a hole formed therein. One of the wheels 158 is secured to the front one of the posts 175 by a screw 159 that extends through the hole in the wheel 158 and is threadably received within the mounting bore in the front one of the posts 175. The other one of the wheels 158 is snapped onto the snap-fit 157.

The arm 160 is integrally joined to the carriage 152, toward the anterior end 154, and extends upward from the carriage 152 at a substantially right angle. In this manner, the arm 160 and the carriage 152 form an L-shaped support 170. The arm 160 has a narrow top portion 162 joined to a bottom portion 164 at a pair of shoulders 166. A plurality of vertically-aligned teeth 168 are formed in an interior surface of the top portion 162. Each of the teeth 168 slopes upward and terminates at a ledge 168*a* (shown best in FIG. 7).

Preferably, the support assemblies 100 are respectively mounted to the side structures 32 of the upper rack 30 when the upper rack 30 is outside the cleaning chamber 14, away from the washer 10. Each support assembly 100 is mounted to its respective side structure 32 by first positioning the base structure 102 over an interior side of the side structure 32. Preferably, the base structure 102 is positioned midway along the length of the side structure 32. The base structure 102 is placed into contact with the side structure 32 such that the ribs 117 extend between a pair of the vertical wire segments 34, and such that the lower horizontal wire segment 36 is disposed-within the horizontal mounting groove formed by the clips 118. With the base structure 102 so positioned, the vertical wire segments 34 are disposed adjacent to an outer pair of the ribs 117 and each extend through one of the gaps 119.

Once the base structure 102 is positioned against the interior side of the side structure 32, the support 170 is attached to the base structure 102 by first inserting the T-shaped projection 172 into the slot 132 of the guide bar 125 while the carriage 152 is positioned parallel to the guide bar 125. The support 170 is then rotated until the arm 160 is disposed parallel to the ribs 117. The arm 160 is then positioned through the vertical wire segments 34 and between the guide members 120. With the support 170 positioned in this manner, the head 173 is trapped behind the central planar member 127, thereby slidably attaching the support 170 to the base structure 102.

After the support 170 is slidably attached to the base structure 102, the cover plate 140 is aligned over the base structure 102, on an exterior side of the side structure 32. The cover plate 140 and the base structure 102 are aligned such that the holes 143 in the cover plate 140 are aligned with the bores 116 in the mounts 115 of the base structure 102. Screws 182 are then passed through the holes 143 and are threaded into the bores 116 to secure the cover plate 140 to the base structure 102 and, thereby, form the bracket 180. The securement of the cover plate 140 to the base structure 102 traps the side structure 32 between the cover plate 140 and the base structure 102, thereby securing the bracket 180 to the side structure 32.

Inside the assembled bracket 180, a vertical slide passage is formed between the interior surface 146 of the cover plate 140 and the ribs 117 of the base structure 102. In addition, the walls 144 are spaced from the inner surface 109 of the base structure 102 so as to form a pair of side conduits therebetween. The side conduits extend between the gaps 119 in the base structure 102 and the notches 147 in the cover plate 140. The vertical wire segments 34 are disposed in the-side conduits and extend therethrough.

The arm 160 is disposed in the slide passage and is engaged by the detent 137. Specifically, the detent 137 engages one of the teeth 168 such that the overhang 137*a* is supported on the ledge 168*a*. As a result, the bracket 180 is locked to the arm 160 at a first position. As used herein with regard to the detent 137 and the arm 160, the term "locked" shall mean secured from downward movement relative to the arm 160.

The detent 137 is disengaged from the arm 160 by bending the lever 135 outward, away from the cover plate 140. When the detent 137 is disengaged from the arm 160, the bracket 180 can freely slide up and down the arm 160. The movement of the bracket 180 along the arm 160 is limited by the T-shaped projection 172, which slides through the slot 132 in the guide bar 125 when the bracket 180 is moved along the arm 160. The bracket 180 can be moved upward until the base 174 of the T-shaped projection 172 abuts a bottom portion of the interior edge 126 of the guide bar 125. Similarly, the bracket 180 can be moved downward until the base 174 abuts a top portion of the interior edge 126. The abutment of the base 174 with the top and bottom portions of the interior edge 126, respectively establishes uppermost and lowermost positions for the bracket 180 relative to the arm 160. When the bracket 180 is in the uppermost position, the detent 137 is aligned with an uppermost one of the teeth 168. When the bracket 180 is in the lowermost position, the detent 137 is aligned with a lowermost one of the teeth 168.

Once the support assemblies 100 are secured to the upper rack 30, the support assemblies 100 are then mounted to the slide bars 60. The front caps 62 of the slide bars 60 are removed and the carriages 152 are respectively rolled into the slide bars 60 until the anterior ends 154 are fully disposed therein. The front caps 62 are then replaced. The front and rear caps 62, 63 prevent the carriages 152 from being rolled out of the slide bars 60.

Referring back to FIGS. 2, 3, one of the carriages 152 is shown mounted inside one of the slide bars 60. Inside the slide bar 60, the wheels 158 of the carriage 152 are supported on the lower flange 66*b* of the slide bar 60. The wheels 158 are free to rotate within the slide bars 60 so as to permit the upper rack 30 to be rolled along the slide bars 60. The wheels 158, however, are trapped between the central planar member 64 and the retaining lips on the upper and lower flanges 66*a*, 66*b*, thereby preventing inward movement of the wheels 158.

The support assemblies 100 selectively support the upper rack 30 on the slide bars 60 at a plurality of vertical positions. When the brackets 180 are located in their lowermost positions, the support assemblies 100 support the upper rack 30 on the slide bars 60 at a lowermost vertical position. When, the brackets 180 are located in their uppermost positions, the support assemblies 100 support the upper rack 30 on the slide bars 60 at an uppermost vertical position.

In order to lower the upper rack 30, an operator must adjust the support assemblies 100. With one hand dedicated to each of the side structures 32, the operator curls his/her fingers under portions of the upper horizontal wire segments 35 located proximate to the support assemblies 100, and presses his/her thumbs against the thumb pads 139 to bend the levers 135 outward. The detents 137 disengage from an upper pair of the teeth 168, thereby permitting the brackets 180 to be moved down the arms 160.

While supporting the upper rack 30, the operator lowers the upper rack 30 to a lower position and then releases the levers 135, thereby causing the detents 137 to move inward. If the detents 137 are properly aligned with a lower pair of the teeth 168, the overhangs 137*a* of the detents 137 will abut the ledges 168*a* of the lower pair of the teeth 168, thereby locking the brackets 180 to the arm 160s at the lower position. If, however, the detents 137 are midway along the lower pair of the teeth 168 when the levers 135 are released, the detents 137 will slide down the lower pair of the teeth 168 until the overhangs 137*a* of the detents 137 abut the ledges 168*a* of the next lower pair of the teeth 168, thereby locking the brackets 180 to the arms 160 at a next-lower position. In this manner, the upper rack 30 can be lowered without precisely aligning the detents 137 with a pair of the teeth 168.

In order to raise the upper rack 30 from a lower position to an upper position, the operator simply grabs the upper rack 30 and lifts the rack to a higher position. The application of an upward force to the upper rack 30 causes the brackets 180 and, thus, the detents 137 to move upward. As the detents 137 slide upward along an upper pair of the teeth 168, the detents 137 and, thus, the levers 135 are forced outward by the upward slopes of the upper pair of the teeth 168. When the detents 137 reach the ledges 168*a* of the upper pair of the teeth 168, the levers 135 resiliently move inward, thereby moving the detents 137 inward. As a result, the overhangs 137*a* of the detents 137 adjoin the ledges 168*a* of the upper pair of the teeth 168.

If the operator ceases lifting the upper rack 30, the brackets 180 will be locked to the arms 160. If, however, the operator continues to move the upper rack 30 upward, the foregoing movement of the detents 137 and the levers 135 is repeated for each successive pair of teeth 168. When. the upward movement of the upper rack 30 finally terminates, the detents 137 will seek and engage the ledges 168*a* of a pair of the teeth 168 in the same manner as when the-upper rack 30 is being raised, thereby locking the brackets 180 to the arms 160.

It should be appreciated that the support assemblies 100 provide numerous benefits. Each of the support assemblies 100 has only three major components that need to be assembled together: the base structure 102, the cover plate 140 and the support 170. This minimal number of components significantly reduces manufacturing and installation costs. The support assemblies 100 are also easily manipulated to support the upper rack 30 at a plurality of vertical positions extending from the uppermost vertical position to the lowermost vertical position. As described above, the operator can raise and lower the upper rack in one operation. To raise the upper rack 30, the operator simply grabs the upper rack 30 and lifts. To lower the upper rack 30, the operator depresses the two thumb pads 139 and lowers the upper rack 30.

Although the preferred embodiment of this invention has been shown and described, it should be understood that various modifications and rearrangements of the parts may be resorted to without departing from the scope of the invention as disclosed and claimed herein.

What is claimed is:

1. A support assembly for supporting a holding rack on a wall-mounted track in a washer, said support assembly comprising:

an arm having a plurality of teeth;

a wheel for insertion into the track, said wheel being rotatably interconnected to the arm;

a carriage joined to an end of the arm, said carriage having the wheel and a second wheel rotatable mounted thereto;

a bracket for attachment to the rack, said bracket including a base structure having a guide bar defining an elongated slot, and a cover plate secured to the base structure, said base structure and said cover plate cooperating to define a passage through which the arm extends, said bracket being movable relative to the arm;

a retaining structure joined to the carriage and extending through the slot in the guide bar, said retaining structure moving in the slot in response to relative movement between the bracket and the arm; and a lever joined to the bracket and having a detent engaged with one of the teeth so as to support the bracket on the arm in a first vertical position, said lever being resiliently movable to permit the detent to be disengaged from the first one of the teeth and moved into engagement with a second one of the teeth, thereby supporting the bracket on the arm in a second vertical position.

2. The support assembly of claim 1 wherein the carriage is elongated and is joined to the arm at a substantially right angle; and wherein the wheel is rotatably mounted proximate a first end of the carriage, and the second wheel is rotatably mounted proximate a second end of the carriage.

3. The support assembly of claim 1 further comprising a thumb pad joined to an upper end of the lever.

4. The support assembly of claim 1 wherein the retaining structure has a head disposed on a side of the guide bar opposite the carriage, said head having a width larger than the slot so as to trap the guide bar between the head and the carriage, thereby securing the carriage to the bracket.

5. The support assembly of claim 1 wherein the teeth are vertically aligned, and wherein the passage extends vertically through the bracket.

6. The support assembly of claim 5 wherein each of the teeth slope upward to a ledge, and wherein the detent slopes downward to an overhang.

7. A holding rack for installation in a washer having a track secured to a side wall of a tub, said rack comprising:

a side structure having an exterior side for disposal adjacent to the side wall, and an opposing interior side;

an arm having a plurality of retaining structures;

a carriage for insertion into the track, said carriage being joined to the arm and having a plurality of wheels rotatably mounted thereto;

a bracket having a base structure disposed adjacent to the interior side of the side structure, and a cover plate disposed adjacent to the exterior side of the side structure, said cover plate being secured to the base structure so as to trap the side structure between the cover plate and the base structure, thereby attaching the bracket to the side structure, said base structure cooperating with said cover plate to define a passage through which the arm extends, said bracket being movable relative to the arm; and a lever joined to the bracket and having a detent, said detent being engaged with a first one of the retaining structures so as to support the side structure on the arm at a first vertical position, said lever being resiliently movable to permit the detent to be disengaged from the first one of the retaining structures and moved into engagement with a second one of the retaining structures, thereby supporting the side structure on the arm in a second vertical position.

8. The holding rack of claim 7 wherein the side structure is comprised of vertical wire segments and horizontal wire segments.

9. The holding rack of claim 8 wherein the bracket defines a horizontal groove through which one of the horizontal wire segments extends, said horizontal groove being disposed adjacent to the passage; and wherein the bracket defines a pair of conduits through which a pair of the vertical wire segments respectively extend, said conduits being disposed on opposing sides of the passage.

10. The holding rack of claim 7 wherein the retaining structures are comprised of vertically-aligned teeth.

11. The holding rack of claim 7 further comprising a thumb pad joined to an upper end of the lever, said thumb pad being disposed inside the holding rack.

12. The holding rack of claim 7 wherein the carriage is elongated and is joined to the arm at a substantially right angle.

13. The holding rack of claim 7 wherein the base structure comprises a guide bar defining an elongated slot, said guide bar being disposed adjacent to the carriage.

14. The holding rack of claim 13 further comprising a post joined to the carriage and extending through the slot, said post being movable through the slot in response to relative movement between the bracket and the arm.

15. A washer comprising:

a tub having opposing side walls, each of said side walls having a track secured thereto;

a holding rack having opposing side structures;

a pair of arms;

a pair of carriages movably disposed within the tracks, said carriages being respectively joined to the arms and each having a pair of wheels rotatably mounted thereto;

a pair of brackets respectively attached to the side structures, said brackets each defining a passage through which one of the arms extends and each comprising a base structure and a cover plate secured together with one of the side structures trapped in between, said base structures each having a guide bar defining an elongated slot, said brackets being movable relative to the arms so as to permit the rack to be movable between a plurality of vertical positions;

a pair of retaining structures respectively secured to the carriages and extending through the slots in the guide bars, said retaining structures being movable through the slots in response to relative movement between the brackets and the arms; and a pair of levers respectively extending from the brackets and each having a detent, said detents being engageable with the arms so as to lock the brackets to the arms at a first one of the vertical positions, said levers being resiliently movable to permit the detents to be disengaged from the arms, thereby permitting the upper rack to be moved to a second one of the vertical positions and re-engaged with the arms to lock the brackets to the arms at the second one of the vertical positions.

16. The washer of claim 15 wherein each of the arms has a plurality of vertically aligned teeth that are engaged by one of the detents.

17. The washer of claim 15 wherein the holding rack is an upper rack, and wherein the washer further comprises a lower rack disposed below the upper rack.

* * * * *